US008888994B2

(12) United States Patent
Kukhar et al.

(10) Patent No.: US 8,888,994 B2
(45) Date of Patent: Nov. 18, 2014

(54) METHOD FOR DEEP DESULPHURIZATION OF HYDROCARBON FUELS

(75) Inventors: Valerii Kukhar, Kiev (UA); Volodymir Kashkovski, Kiev (UA); Vladislav Kyselov, Kiev (UA); Yurii Besugly, Kiev (UA); Yurii Kyselov, Kiev (UA); Rajender Varma, Cincinnati, OH (US); Subhas Sikdar, Cincinnati, OH (US)

(73) Assignee: The United States of America as represented by the Administrator of the U.S. Environmental Protection Agency, Washington, DC (US)

( * ) Notice: Subject to any disclaimer, the term of this patent is extended or adjusted under 35 U.S.C. 154(b) by 486 days.

(21) Appl. No.: 13/090,157

(22) Filed: Apr. 19, 2011

(65) Prior Publication Data

US 2011/0259797 A1 Oct. 27, 2011

(30) Foreign Application Priority Data

Apr. 22, 2010 (UA) ..... 2010040857

(51) Int. Cl.

| | |
|---|---|
| ***C10G 27/00*** | (2006.01) |
| ***C10G 27/04*** | (2006.01) |
| ***C10G 27/14*** | (2006.01) |
| ***C10G 25/06*** | (2006.01) |
| ***C10G 53/08*** | (2006.01) |
| ***C10G 25/05*** | (2006.01) |
| ***C10G 53/14*** | (2006.01) |

(52) U.S. Cl.

CPC ..... *C10G 27/14* (2013.01); *C10G 2300/1044* (2013.01); *C10G 2300/202* (2013.01); *C10G 2400/02* (2013.01); *C10G 53/08* (2013.01); *C10G 2400/04* (2013.01); *C10G 25/05* (2013.01); *C10G 2400/08* (2013.01); *C10G 53/14* (2013.01); *C10G 27/04* (2013.01); *C10G 2300/104* (2013.01); *C10G 2300/1055* (2013.01); *C10G 2300/1051* (2013.01)

USPC ..... 208/245; 208/208 R; 208/236

(58) Field of Classification Search

USPC ..... 208/221, 236, 208 R, 237, 240, 245; 585/824

See application file for complete search history.

(56) References Cited

U.S. PATENT DOCUMENTS

| | | | | |
|---|---|---|---|---|
| 3,394,200 | A * | 7/1968 | Sargent | 585/824 |
| 4,485,007 | A * | 11/1984 | Tam et al. | 208/221 |
| 2006/0000750 | A1* | 1/2006 | Louis et al. | 208/208 R |
| 2006/0180501 | A1* | 8/2006 | Da Silva et al. | 208/208 R |
| 2006/0226049 | A1* | 10/2006 | Nemeth et al. | 208/208 R |
| 2007/0138062 | A1 | 6/2007 | Varma et al. | |
| 2008/0257785 | A1 | 10/2008 | Varma et al. | |
| 2008/0308463 | A1* | 12/2008 | Keckler et al. | 208/249 |

FOREIGN PATENT DOCUMENTS

EP 1715025 10/2006

OTHER PUBLICATIONS

Babich I.V.; Moulijn J.A. Fuel. 2003, 82 (6), 607-631.
Song, C. Catal. Today. 2003, 86 (1-4), 211-263.
Aslanov L.A., Anisimov A.V. Neftekhimiya. 2004, 44 (2), 83-88).
Sharipov A.Kh, Nygmatullyn V.R. Chemistry and technology of fuels and lubricants. 2005, 4, 42-43).
Shiraishi Y., Yamada A., Hirai T. Energy and Fuels. 2004, 18 (5), 1400-1404.
Ke Tang et al. Fuel Proc. Technol. 2008, 89 (1) 1-6 3.
Ishihara A. et al. Appl. Catal. A: General. 2005, 279 (1-2), 279-287I.
Velu S. et al. Energy and Fuels. 2005, 19 (3), 1116-1125.
Ma, C.; Zhou, A.; Song, C. Catal. Today. 2007, 123 (1-4), 276-284.
Liu B.S. et al. Energy and Fuels. 2007, 21 (1), 250-255, etc.].
Kemsley, J. Targeting sulfur in fuels for 2006.

* cited by examiner

*Primary Examiner* — Prem C Singh
*Assistant Examiner* — Brandi M Doyle
(74) *Attorney, Agent, or Firm* — Weiss & Moy, P.C.

(57) ABSTRACT

Method for deep desulphurization of hydrocarbon fuels includes following steps: (1) treatment of a hydrocarbon fuel under the condition of its mixing with gaseous oxidant selected from the group consisting nitrogen monoxide, dry air, ozone and a mixture of at least two of said reagents in order to oxidize sulfur-containing compounds presented in said fuel, and with a fine-dispersed adsorbent based on montmorillonite in order to adsorb oxidized sulfur-containing compounds, and (2) separation of spent adsorbent together with adsorbed oxidized sulfur-containing compounds from refined fuel.

18 Claims, No Drawings

METHOD FOR DEEP DESULPHURIZATION OF HYDROCARBON FUELS

CROSS-REFERENCE TO RELATED APPLICATIONS

This application claims priority to co-pending Ukraine Patent Application No. a 2010 04857 filed on Apr. 22, 2010 in the names of the Applicants herein. This application is also related to co-pending U.S. application Ser. No. 12/134,536 filed on Jun. 6, 2008. This application is also related to U.S. application Ser. No. 11/300,856 filed on Dec. 15, 2005, now abandoned.

FIELD OF THE INVENTION

This invention relates to the technology of deep desulphurization of hydrocarbon fuels by at least partial oxidation of sulfur-containing compounds and adsorption of their oxidation products.

It should be noted that the term "hydrocarbon fuel" (or in abbreviated form "fuel") designates hereinafter any gasoline, kerosene, diesel fuel, and petroleum products meant for fuel cells, or any arbitrary mixture thereof.

BACKGROUND OF THE INVENTION

It's well known that sulfur is one of the main impurities of hydrocarbon raw materials. Its concentration in fuels ranges from hundredths of percent up to 10% or above [1. Ляпина Н. К. Химия и физикохимия сераорганических соединений нефтяных дистиллятов.—М.: Наука, 1984 (In English: Lyapyna N. K. Chemistry and physical chemistry of oil distillates of sulfur-organic compounds.—Moscow: Publishing House 'Nauka', 1984), 2. Большаков Г.Ф. Сераорганические соединения нефти.—Новосибирск: Наука, 1986 (In English: Bolshakov G. F. Sulfur-organic compounds of oil.—Novosibirsk: Publishing House 'Nauka', 1986)].

It's generally known too that, during exhaustion of the world oilfields, percentage of sulfur compounds in crude oil increases. Petroleum products derived from crude oil contain, as a rule, appreciable concentration of sulfur. Combustion of such products yearly causes oxidation of about $40*10^6$ tons of sulfur equivalent to approximately $80*10^6$ tons of sulfur dioxide or $120*10^6$ tons of sulfuric acid [Харлампиди Х.Э Сераорганические соединения нефти, методы очистки и модификации. Соросовский образовательный журнал.—2000, Т. 6, N° 7, с. 42-46 (In English: Harlampydy Kh.E. Sulfur-organic compounds of oil, methods of cleaning and modification.—Soros educational magazine.—2000, v. 6, N° 7, pp. 42-46].

Oxides of sulfur released to the environment from fuel combustion cause acid rains, which negatively affects the ecosystem of the Earth. Moreover, sulfur-containing compounds cause poisoning of catalysts used for after-burning of exhausts. As a result, large amount of nitrogen oxides and products of incomplete oxidation of hydrocarbons are released into the atmosphere.

Developed countries, which are most affected by these emissions, have determined that sulfur concentration in hydrocarbon fuels must be no more than 30 ppm in gasoline and no more than 15 ppm in diesel fuel. Still more requirements are applied to sulfur concentration in petroleum products, which are meant for fuel cells (in particular less than 10 ppm for solid oxide fuel cells, and less than 1 ppm for proton-exchange membrane fuel cells).

Preventing the emission of sulfur-containing compounds into atmosphere from fuel combustion is a major engineering and environmental problem, for which the solution of deep desulphurization of fuels is necessary.

Main sulfur-containing impurities of oils and petroleum products are mercaptans (RSH), sulfides (RSR'), disulfides (RSSR'), and cyclic sulfides ($C_nH_{2n}S$). More than 250 sulfur-containing compounds have been identified and many of them have been isolated from oils.

Many different methods for desulphurization have been proposed. For instance, oil refineries extensively use hydrodesulphurization (i.e. HDS-process) based on selective hydrogenolysis of C—S bonds using a catalyst such as Co—$Mo/Al_2O_3$ or Ni—$Mo/Al_2O_3$ at high temperature 320-380° C. and under a pressure of 3-7 megapascal. However, possibilities to improve the HDS-process by increasing catalyst's activity, optimization of operating practices and enhancement of equipment are now almost exhausted. In fact, latest reports about more efficient catalysts for the HDS-process were published at the beginning of XXI century [Kemsley, J. Targeting sulfur in fuels for 2006].

Unfortunately, any embodiment of the HDS-process generates hydrogen sulfide, which should be prevented. Further, said process is not able to remove effectively some sulfur-containing compounds (including cyclic and polycyclic monoalkylated and polyalkylated sulfur-containing compounds, such as alkyl benz- and alkyl dibenzthiophens which are usually present in kerosene, diesel fuel and vacuum gas-oil) though hydrogenolysis rate increases in series "mercaptans>disulfides>sulfides thiophens". Moreover, the HDS-process is accompanied by hydrocracking and hydrogenolysis of olefins, dehydrogenation of naphthenic hydrocarbons and cyclodehydrogenation of alkanes that alters hydrocarbon composition of end products and causes degradation of gasoline's octane number or diesel fuels' cetane number. Increase of temperature and pressure in the HDS-process meant for deep desulphurization causes intensification of said side reactions.

Other desulphurization methods, such as biodesulphurization, extraction of sulfur with mineral and organic acids, desulphurization with ionic liquids, adsorption, etc were developed recently [see, for example: 1. Babich I. V.; Moulijn J. A. Fuel. 2003, 82 (6), 607-631 2. Song, C. Catal. Today. 2003, 86 (1-4), 211-263; 3. Асланов Л. А.; Анисимов А.В. Нефтехимия.. 2004, 44 (2), 83-88 (In English: Aslanov L. A., Anisimov A. V. Neftekhimiya. 2004, 44 (2), 83-88)].

These methods are efficient only for removing of mercaptans, thioesters and disulfides but are practically unsuitable for removing of thiophens (especially benztiophens, dibenzthiophens and other thiophens, which include condensed cycles, or their substituted derivates).

Therefore, it is necessary to develop highly effective and inexpensive desulphurization methods, which do not practically alter composition and combustion efficiency of hydrocarbon fuels.

In particular, a special group of desulphurization methods based on oxidation of sulfur-containing compounds, adsorption of their oxidation products and separation of spent adsorbent are known [1. Шарипов А.Х., Нигматуллин В.Р. Химия и технология топлив и масел. 2005, 4, 42-43; (In English: Sharipov A.Kh, Nygmatullyn V. R. Chemistry and technology of fuels and lubricants. 2005, 4, 42-43); 2. Shiraishi Y., Yamada A., Hirai T. Energy and Fuels. 2004, 18 (5), 1400-1404; 3. Ke Tang et al. Fuel Proc. Technol. 2008, 89 (1) 1-6 3; 4. Ishihara A. et al. Appl. Catal. A: General. 2005, 279 (1-2), 279-2871 5. EP 1715025, 2006; 6. Velu S. et al. Energy and Fuels. 2005, 19 (3), 1116-1125; 7. Ma, C.; Zhou, A.; Song, C. Catal. Today. 2007, 123 (1-4), 276-284; 8. Liu B. S. et al. Energy and Fuels. 2007, 21 (1), 250-255, etc.].

A technical solution, which is closest to the proposed below invention, was described in US Patent Application No 2008/0257785 (Oct. 23, 2008; Varma R. S, Yuhong Ju, Sikdar S.). The known method for desulphurization of hydrocarbon fuels provides:

preparation of mixture of a powdered adsorbent based on at least one silicate and an oxidant that is a metal nitrate having high affinity to sulfur, contact of this mixture with hydrocarbon fuel, which must be desulphurized, at temperature in the range from 20° C. to 50° C. under atmospheric pressure over the time that is sufficient for effective oxidation and adsorption of sulfur-containing compounds, and then separation of spent adsorbent together with adsorbed oxidized sulfur-containing compounds from refined fuel.

Silicate can be selected from the group consisting of clay minerals such as montmorillonite, laumontite, bentonite, mica, vermiculite and kaolin, but usually modified montmorillonite K-10 from Aldrich Chemical Co. (USA) is used. Oxidant (in an amount from 5% to 35% of the adsorbent powder mass) can be selected from the group consisting of metals' nitrates such as iron (II) or (III), zinc (II), cadmium (II) and mercury (II), but mainly the mixture of iron nitrate (III) nonahydrate is used. Said mixture is prepared by careful grinding and mixing of selected solid oxidant and selected clay mineral practically ex tempora because activity of makeup mixture quickly decreases.

An experimental embodiment of aforesaid method showed that it is sufficiently effective for the purpose of hydrocarbon fuels purification from sulfur-containing compounds such as 2-methyl benzthiophen and 4,6-methyl dybenzthiophen even if their concentrations in treated fuel are low.

Unfortunately, use of said solid oxidants and necessity of their careful grinding with clay minerals practically before stirring of obtained mixtures and processed fuels complicates desulphurization substantially and increases the risk of environmental damage that can be caused by spent adsorbents (especially when they contain cadmium or mercury).

SUMMARY OF THE INVENTION

The invention is based on the problem to create—by modification the aggregate state of oxidant and process conditions—a simpler and more environmentally friendly method for deep desulphurization of hydrocarbon fuels.

This problem is solved in that a method for deep desulphurization of hydrocarbon fuels according to the invention provides:

treatment of a hydrocarbon fuel under the condition of its mixing with gaseous oxidant selected from the group consisting nitrogen monoxide, dry air, ozone and a mixture of at least two of said reagents in order to oxidize sulfur-containing compounds presented in said fuel, and with a fine-dispersed adsorbent based on montmorillonite in order to adsorb oxidized sulfur-containing compounds, and separation of spent adsorbent together with adsorbed oxidized sulfur-containing compounds from refined fuel.

Use of gaseous oxidants substantially simplifies the desulphurization process and prevents contamination of spent adsorbent and the environment by metal ions (especially by toxic metal ions, such as cadmium and mercury) too.

The first additional feature is that the hydrocarbon fuel is mixed with said adsorbent in order to form the suspension before the addition of selected gaseous oxidant. This order of preparation of reaction mixture and desulphurization creates conditions for oxidation of sulfur-containing components of fuel on catalytically active surface of the solid adsorbent's micro-particles.

Accordingly, the following additional features are that said suspension is mixed, during its treatment, by bubbling of selected gaseous oxidant through a layer of suspension, especially in the recirculation mode. This further simplifies the proposed method because allows to exclude mechanical stirring.

Yet another additional feature is that the hydrocarbon fuel is firstly treated by selected gaseous oxidant and then is mixed with said adsorbent within a few minutes. This sequencing is desired because the fuel after said treatment contains polar derivates of hydrocarbons that can be absorbed together with oxidized sulfur-containing compounds.

DETAILED DESCRIPTION OF THE PREFERRED EMBODIMENTS

The proposed method is carried out as follows. A batch of a hydrocarbon fuel meant for desulphurization must be taken, and then initial concentration of sulfur-containing compounds in this batch must be measured using highly sensitive method (e.g. X-ray fluorescence analysis).

A typical embodiment of the proposed process includes pouring of said fuel batch into an intermittent reaction vessel equipped with a stirring device, engagement of said device and, as a rule, gradual introduction of a fine-dispersed adsorbent based on montmorillonite into said fuel batch in order to obtain a suspension.

Specific discharge of said adsorbent may be defined by preliminary sets of laboratory experiments taking into consideration the adsorbent's adsorption capacity and initial concentration of sulfur-containing compounds in a fuel. Typically, average discharge of the adsorbent is less than or about 40 kg per 1000 liters of a fuel.

The next step is addition of a selected gaseous oxidant to the mixed suspension. This process takes a time sufficient for oxidation of sulfur-containing impurities of the fuel and adsorption of their oxidation products on the particles of selected adsorbent. The time needed for processing and absorption are also determined experimentally in advance.

Continuous mixing of said suspension with gaseous oxidant is performed using a suitable mechanical stirrer or by bubbling of selected gaseous oxidant through the suspension layer (especially, in recirculation mode) or by combining of these methods of mixing. Clearly, use of bubbling method of mixing would be enough for industrial desulphurization apparatus.

The process may be carried out at temperature in the range from 20° C. to 30° C.

The gaseous oxidant is usually selected from the group consisting of nitrogen monoxide, dry air, ozone and a mixture of at least two of these reagents, but mainly nitrogen monoxide is used.

It is possible such embodiment of said process, in which a fuel batch is firstly treated by selected gaseous oxidant and then is mixed with said adsorbent within a few minutes.

At the final step, spent adsorbent together with adsorbed oxidized sulfur-containing components are separated from refined fuel by filtration or centrifugation.

Refined fuel is delivered to sale, and spent adsorbent is transmitted to a dump.

It is clear for each person skilled in the art that the proposed desulphurization method, can be carried out in other apparatuses such as flow absorber with at least one layer of adsorbent arranged between gas-permeable partitions (especially when refining fuel would be recirculating). In this case it is expedient to use cartridges with disperse adsorbent that can be easily replaced before exhaustion of their adsorption capacity.

Practicability and effectiveness of the described method were tested experimentally in laboratory conditions (mainly according to the principle "introduced-detected").

Usually, the model solutions of 4-methyldybenzthiophen (hereinafter 4-MDBT) according to the Aldrich technical terms CAS 7372-88-5 and 4,6-dymethyldybenzthiophen (hereinafter 4,6-DMDBT) according to the Aldrich technical terms CAS 1207-12-1) in hexane were used for experiments because the 4-MDBT and the 4,6-DMDBT are typical sulfur-containing impurities having condensed cycles and, respectively, hexane is the typical hydrocarbon component of fuels produced from oil. Aforesaid solutions were prepared in advance on conditions that each 5 ml of the model solution must contain such amounts of the 4-MDBT and the 4,6-DMDBT that are equivalent to the sulfur concentrations of 215 ppm and 450 ppm separately and 665 ppm in total.

Modified montmorillonite K-10 from Aldrich Chemical Co. (USA), which was carefully grinded directly before experiments, was used as adsorbent.

Nitrogen monoxide NO was obtained by adding drops of 40% $NaNO_2$ water solution to the mixture of equal volumes of 20% water solution of $FeSO_4$ and hydrochloric acid having density 1.19 g/cm$^3$. Ozone was obtained by passing of dry air through a flask with glow discharge.

Laboratory vessels were preliminarily blowed out by argon, an amount of which was used until the end of each experiment, as a rule, as a protective layer above the reaction mixture, or as an accompanying inert additive to the selected gaseous oxidant during its bubbling.

The concentration of sulfur in fuel was determined using X-ray fluorescence method. Desulphurization rate was evaluated as the percentage of the separated sulfur amount against the amount of sulfur that was added to hexane or presented in real diesel fuel initially. Specific amount of adsorbed sulfur (in milligrams of sulfur per 1 gram of adsorbent that is designed further S/g) was calculated according to the formula:

$$\frac{(C - C_1)Vd10^9}{m}$$

where

C—initial sulfur concentration in fuel or model solution (ppm);

$C_1$—final sulfur concentration in fuel or model solution after desulphurization (ppm);

V—batch volume of fuel or model solution (cm$^3$);

d—density of fuel or model solution (g/cm$^3$);

m—mass of the adsorbent batch (g).

Values of desulphurization rates were accepted if difference between final sulfur concentration in refined fuel or model solution and its average concentration for each set composed of 10 identical experiments was less than ±5%.

Here are the examples of realization of the proposed method.

EXAMPLE 1

Study of NO Discharge Effect on Desulphurization Efficiency

At the start of each experiment 5 ml of said solution of the 4-MDBT and the 4,6-DMDBT in hexane was poured into 50 ml capacity flask equipped with stirrer, and then 0.4 g of said adsorbent K-10 was added under mixing. Obtained suspensions were treated by nitrogen monoxide for three hours under mixing and at temperature from 20 to 30° C.; at that discharge NO for one experiment was $1.34*10^{-4}$ mole or $2.68*10^{-4}$ mole respectively in the first and second sets of 10 experiments.

Spent adsorbent was separated by filtration at the end of each experiment. Obtained data are presented in Table 1.

TABLE 1

NO discharge effect on desulphurization efficiency

| | Discharge of | Efficiency | |
|---|---|---|---|
| Set of experiments | NO per one experiment | Desulphurization rate, % | mg S/g K-!0 |
| First | $1.34 * 10^{-4}$ mole | 86.9 | 4.84 |
| Second | $2.68 * 10^{-4}$ mole | 91.9 | 5.12 |

As it is showed in Table 1, desulphurisation rate and specific amount of adsorbed sulfur could be regulated by change of the NO discharge, but dependence of these parameters from NO discharge is nonlinear. Therefore, suitable values of NO discharge should be ultimately determined in experimental way.

EXAMPLE 2

Study of Adsorbent Discharge Effect on Desulphurisation Efficiency

At the start of each experiment 5 ml of said solution of the 4-MDBT and the 4,6-DMDBT in hexane was poured in 50 ml capacity flask equipped with stirrer, and then 0.2 g, or 0.4 g, or 0.6 g of said adsorbent K-10 were added under mixing in the first, second and third set of 10 experiments respectively. Obtained suspensions were treated with $2.68*10^{-4}$ mole of nitrogen monoxide for six hours under mixing at temperature from 20 to 30° C.

The experiments were ended as in the Example 1. Obtained data are presented in Table 2.

TABLE 2

Adsorbent discharge effect on desulphurization efficiency

| | Discharge of the | Efficiency | |
|---|---|---|---|
| Set of experiments | adsorbent per one experiment, g | Desulphurization rate, % | mg S/g K-!0 |
| First | 0.2 | 87 | 9.69 |
| Second | 0.4 | 97 | 5.40 |
| Third | 0.6 | practically 100 (« non detect») | 3.71 |

As it is showed in Table 2, desulphurization rate could be regulated also by change of the adsorbent discharge. However, in this case a compromise between a desired desulphurization rate and an acceptable adsorbent discharge must be found because increase of said rate is accompanied by substantial decrease of specific amount of adsorbed sulfur.

EXAMPLE 3

Comparison of Effects of Composition and Discharge of Oxidant and Process Duration on Desulphurization Efficiency Each experiment was started as in the Example 1, and then obtained suspensions:

a) were treated in first and second sets of ten experiments as in the Example 1;

b) were treated in additional set of 10 experiments by mixture of $1.34*10^{-4}$ mole of nitrogen monoxide and dry air in amount equal $3.3*10^{-4}$ mole of oxygen per 1 experiment during six hours at temperature in the range from 20 to 30° C.

The experiments were ended as in the Example 1. Obtained data are presented in Table 3.

TABLE 3

Effects of composition and discharge of oxidant and process duration on desulphurization efficiency

| Set of experiments | Type of oxidant and its discharge | Efficiency | |
|---|---|---|---|
| | | Desulphurization rate, % | mg S/g K-!0 |
| First | $1.34 * 10^{-4}$ mole of NO | 87 | 4.84 |
| Second | $2.68 * 10^{-4}$ mole of NO | 92 | 5.12 |
| Third | $1.34 * 10^{-4}$ mole of NO + $3.3 * 10^{-4}$ mole of $O_2$ | 96.5 | 5.37 |

As it is showed in Table 3, the use of nitrogen monoxide together with dry air and increasing of process duration raises desulphurization rate and specific amount of adsorbed sulfur adsorbent against the stable discharge of the adsorbent.

EXAMPLE 4

Study of Effect of Exposure Time of the Reaction System "Gas-Suspension" on Duration and Efficiency of Desulphurization Each experiment was started as in the Example 1. Obtained suspensions were one-time treated by $2.68*10^{-4}$ mole of nitrogen monoxide at room temperature, and then each system "gas-suspension" was rested. The desulphurization rate was tested every 4 hours. The experiments were ended, as in the Example 1. Acceptable result of desulphurization 95.6% was obtained only in 124 hours. Therefore, continuous mixing of said reagents is necessary condition of intensive desulphurization.

EXAMPLE 5

Study of Effect of Supply Sequence of the NO and the Adsorbent on Desulphurization Efficiency Each experiment was started as in the Example 1 at the moment when said flasks were poured. Further each batch of aforesaid model solution was firstly mixed with $2.68*10^{-4}$ mole of nitrogen monoxide at room temperature during three hours. Then 0.4 g of said adsorbent was added into each flask under intense stirring, and obtained suspension was still stirred no more than two minutes. The experiments were ended as in the Example 1.

Achievement of 94.8% desulphurization rate shows that the adsorption may be the final step of desulphurization process.

In addition to the described experiments, possibility of desulphurization of high-sulfur summer diesel fuel was also tested. This fuel was obtained by direct distillation <<Urals>> oil, and its samples were taken directly from the rectification column's output.

EXAMPLE 6

Testing of NO Applicability for Diesel Fuel Desulphurization

At the start of each experiment 5 ml of said diesel fuel having an initial sulfur concentration of 6640 ppm were poured into 50 ml capacity flask equipped with a stirrer, and then 0.4 g of said adsorbent K-10 was added under mixing. Obtained suspension was treated under mixing by nitrogen monoxide in amount of $8.9*10^{-4}$ mole per one experiment in three hours at temperature from 20 to 30° C. The experiments were ended as in the Example 1.

Final sulfur concentration in treated diesel fuel was equal 4820 ppm.

This result shows that nitrogen monoxide is suitable in principle for partial preliminary desulphurization of hydrocarbon fuels having high initial concentration of sulfur-containing compounds.

EXAMPLE 7

Testing of Ozone Applicability for Diesel Fuel Desulphurization

At the start of each experiment 5 ml of said diesel fuel having an initial sulfur concentration of 8000 ppm were poured into 50 ml capacity flask equipped with a stirrer, and then ozone was bubbled during 20 minutes. Further 0.4 g of said adsorbent K-10 was added to the reaction mixture under intensive mixing, and obtained suspension was additionally mixed no more than two minutes. The experiments were ended as in the Example 1.

Final sulfur concentration in treated diesel fuel was equal 5820 ppm.

This result shows that ozone is suitable in principle for rapid partial preliminary desulphurization of hydrocarbon fuels having high initial concentration of sulfur-containing compounds.

INDUSTRIAL APPLICABILITY

Proposed method can be used in the petrochemical industry using available apparatuses and reagents.

We claim:

1. A method for deep desulphurization of hydrocarbon fuels, comprising the steps of:

firstly, mixing a fine-dispersed adsorbent based on montmorillonite with liquid hydrocarbon fuel to form a suspension comprising only in the liquid hydrocarbon fuel and the adsorbent;

secondly, continuously mixing a gaseous oxidant with the suspension in order to oxidize sulfur-containing compounds present in the liquid hydrocarbon fuel and to adsorb the oxidized sulfur-containing compounds from the liquid hydrocarbon fuel; and removing spent adsorbent and adsorbed oxidized sulfur-containing compounds from the suspension;

wherein oxidation of the sulfur-containing compounds occurs on catalytically active surfaces of the adsorbent.

2. The method of claim 1 wherein the gaseous oxidant is selected from the group consisting of nitrogen monoxide, dry air, ozone, and a mixture of at least two thereof.

3. The method of claim 1 wherein the step of mixing the gaseous oxidant with the suspension comprises the step of bubbling the gaseous oxidant through a layer of the suspension while the suspensions is being mixed.

4. The method of claim 3 wherein the gaseous oxidant is bubbled through layer of suspension while refining fuel is being recirculated into the suspension.

5. The method of claim 1 wherein the mixing steps are done at a temperature of about 20° C. to 30° C.

6. The method of claim 1 wherein the mixing steps are done under atmospheric pressure.

7. A method for deep desulphurization of hydrocarbon fuels, comprising the steps of:

providing a fine-dispersed adsorbent based on montmorillonite;

creating a suspension by mixing the fine-dispersed adsorbent and liquid hydrocarbon fuel;

providing a gaseous oxidant;

bubbling the gaseous oxidant through a layer of the suspension while the suspension is being mixed;

oxidizing sulfur-containing compounds present in liquid hydrocarbon fuel with the gaseous oxidant and adsorbing the oxidized sulfur-containing compounds from the liquid hydrocarbon fuel;

removing spent adsorbent and adsorbed oxidized sulfur-containing compounds from the suspension;

wherein oxidation of the sulfur-containing compounds occurs on catalytically active surfaces of the adsorbent.

8. The method of claim 7 wherein the gaseous oxidant is selected from the group consisting of nitrogen monoxide, dry air, ozone, and a mixture of at least two thereof.

9. The method of claim 7 wherein the steps of oxidation and adsorption of sulfur-containing compounds are done at a temperature of about 20° C. to 30° C.

10. The method of claim 7 wherein the steps of oxidation and adsorption of sulfur-containing compounds are done under atmospheric pressure.

11. A method for deep desulphurization of hydrocarbon fuels, comprising the steps of:

providing a fine-dispersed adsorbent based on montmorillonite;

mixing the adsorbent with liquid hydrocarbon fuel to create a suspension;

providing a gaseous oxidant;

continuously mixing the suspension with the gaseous oxidant;

oxidizing and adsorbing sulfur-containing compounds from the liquid hydrocarbon fuel; and removing the spent adsorbent and adsorbed oxidized sulfur-containing compounds from the suspension;

wherein oxidation of the sulfur-containing compounds occurs on catalytically active surfaces on the adsorbent.

12. The method of claim 11 wherein the step of mixing the suspension with the gaseous oxidant comprises the step of bubbling the gaseous oxidant through a layer of the suspension while the suspension is being mixed.

13. The method of claim 12 wherein the gaseous oxidant is bubbled through a layer of the suspension while refining fuel is being recirculated into the suspension.

14. The method of claim 11 wherein the steps of oxidation and adsorption of sulfur-containing compounds are done at a temperature of about 20° C. to 30° C.

15. The method of claim 11 wherein the steps of oxidation and adsorption of sulfur-containing compounds are done under atmospheric pressure.

16. A method for deep desulphurization of hydrocarbon fuels, which includes the steps:

creation of a suspension by mixing a fine-dispersed adsorbent based on montmorillonite with liquid hydrocarbon fuel;

treatment of the suspension under the condition of its continuous mixing with a gaseous oxidant selected from the group consisting of nitrogen monoxide, dry air, ozone and a mixture of at least two of said gaseous oxidants in order to oxidize sulfur-containing compounds presented in said fuel, and to adsorb oxidized sulfur-containing compounds, and separation of spent adsorbent together with adsorbed oxidized sulfur-containing compounds from the liquid hydrocarbon fuel;

wherein oxidation of the sulfur-containing compounds occurs on catalytically active surface; of the adsorbent.

17. The method according to claim 16, in which said suspension is mixed, during its treatment, by bubbling of selected gaseous oxidant through a layer of the suspension.

18. The method according to the claim 17, in which said selected gaseous oxidant is bubbled through the layer of the suspension while the liquid hydrocarbon fuel is being recirculated into the suspension.

* * * * *